US008555565B2

(12) United States Patent
Mundle et al.

(10) Patent No.: US 8,555,565 B2
(45) **Date of Patent: *Oct. 15, 2013**

(54) GROUND ANCHOR PROVIDING MINIMAL GROUND DISTURBANCE

(71) Applicant: R U Grounded Energy Inc., Calgary (CA)

(72) Inventors: Terry D. Mundle, Cochrane (CA); Jairus Krahn, High Level (CA)

(73) Assignee: R U Grounded Energy Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/661,305

(22) Filed: Oct. 26, 2012

(65) Prior Publication Data

US 2013/0047522 A1 Feb. 28, 2013

Related U.S. Application Data

(63) Continuation of application No. 11/169,988, filed on Jun. 28, 2005, now Pat. No. 8,312,680.

(30) Foreign Application Priority Data

Nov. 19, 2004 (CA) ..... 2485815

(51) Int. Cl.
*E02D 5/80* (2006.01)

(52) U.S. Cl.
USPC ..... 52/155; 52/148

(58) Field of Classification Search
CPC ..... E02D 5/80
USPC ..... 52/148, 155, 165, DIG. 11; 248/156, 248/545
See application file for complete search history.

(56) References Cited

U.S. PATENT DOCUMENTS

| | | | | |
|---|---|---|---|---|
| 2,870,884 | A * | 1/1959 | Mazur | 52/158 |
| 3,118,416 | A * | 1/1964 | Sawyer | 114/297 |
| 3,684,032 | A * | 8/1972 | Hawkins | 172/720 |
| 4,708,086 | A * | 11/1987 | Brown, Jr. | 114/294 |
| 4,776,140 | A * | 10/1988 | Wight et al. | 52/125.5 |
| 5,123,623 | A * | 6/1992 | McNamara | 248/545 |
| 5,444,949 | A * | 8/1995 | Ciaccio | 52/155 |
| 5,850,715 | A * | 12/1998 | Francis | 52/155 |
| 6,726,160 | B1 * | 4/2004 | Buchanan, Jr. | 248/156 |
| 6,955,243 | B1 * | 10/2005 | Huff | 182/107 |
| 7,047,696 | B2 * | 5/2006 | DiDomenico | 52/166 |

* cited by examiner

*Primary Examiner* — Adriana Figueroa
(74) *Attorney, Agent, or Firm* — Donald V. Tomkins

(57) ABSTRACT

A ground anchor includes a body having an upper surface and a lower surface; ground-piercing members depending from the lower surface of the body, with the ground-piercing members being adapted to engage an underlying ground surface and prevent movement of the body along such ground surface; ballast positioned on or in the body, with the ballast being sufficient to maintain the ground-piercing members engaged with the ground surface when under load; and means for securing an anchor line to the body. Ground-engaging means such as a ground-engaging blade member or flanges may be attached to the ground-piercing members to increase the surface area perpendicular to the line of force to provide additional resistance to movement.

11 Claims, 3 Drawing Sheets

GROUND ANCHOR PROVIDING MINIMAL GROUND DISTURBANCE

FIELD OF THE INVENTION

The present invention relates to a ground anchor for use in environmentally sensitive areas, and which is capable of anchoring with minimal ground disturbance.

BACKGROUND OF THE INVENTION

There are some geographic areas which are designated as environmentally sensitive areas and are protected by law. Work such as oil and gas drilling in environmentally sensitive areas requires a special permit. The special permit is only granted upon condition that there be minimal ground disturbance. Even in areas which are not designated as environmentally sensitive areas, property owners are increasingly imposing conditions relating to minimal ground disturbance when granting access to their property.

What is required is a ground anchor providing minimal ground disturbance.

SUMMARY OF THE INVENTION

According to the present invention there is provided a ground anchor, which includes a body having an upper surface and a lower surface. Ground-piercing members depend from the lower surface of the body. The ground-piercing members are adapted to engage an underlying ground surface and prevent movement of the body along such ground surface. Ballast is positioned on or in the body. The ballast is sufficient to maintain the ground-piercing members engaged with the ground surface when under load. Means are provided for securing an anchor line to the body.

With the ground anchor, as described above, the ground-piercing members are relatively shallow and cause minimal ground disturbance. The relatively shallow ground-piercing members will hold as long as sufficient ballast is provided to maintain the ground-piercing members engaged with the ground surface when under load.

In a first embodiment, the ground anchor comprises a body having an upper surface and a lower surface; a row of ground-piercing members (which may be in the form of teeth) fixed to and depending from the lower surface of the body; means for securing an anchor line to the body; and supplemental ground-engaging means for increasing the anchor's ground-engaging surface area resisting movement of the anchor in response to load applied by an anchor line secured to the body In certain embodiments, the supplemental ground-engaging means may be provided in the form of a ground-engaging blade member attached to the ground-piercing members, with the ground-piercing members having an orientation relative to the ground-engaging blade member that provides more resistance in a first direction perpendicular to the blade member than in an opposed second direction.

In other embodiments, the supplemental ground-engaging means may be provided in the form of flanges on the sides of one or more of the ground-piercing members.

The means for securing an anchor line to the body may comprise an attachment ring, which in some embodiments may be associated with a remote end of an arm pivotally mounted to the anchor body.

The ground anchor may comprise ballast, which may be integrally formed into the body or may be in the form of weights forming a stack on the upper surface of the body.

BRIEF DESCRIPTION OF THE DRAWINGS

These and other features of the invention will become more apparent from the following description in which reference is made to the appended drawings, which are for the purpose of illustration only and are not intended to in any way limit the scope of the invention to the particular embodiment or embodiments shown, wherein.

DETAILED DESCRIPTION OF THE PREFERRED EMBODIMENT

Figure 1:
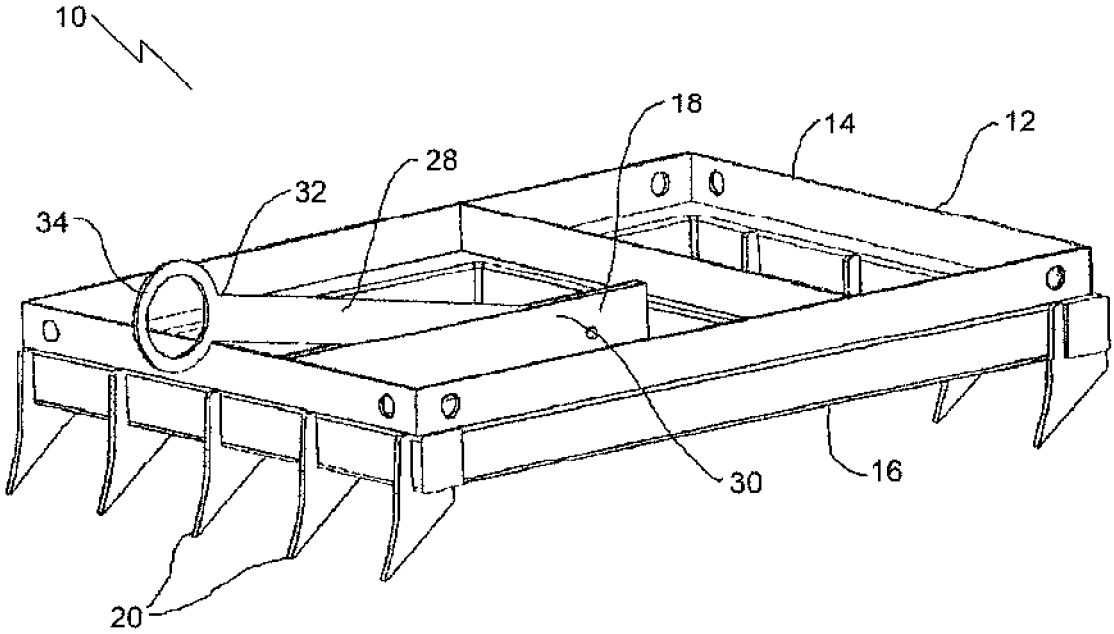
FIG. 1 is a perspective view of a ground anchor constructed in accordance with the teachings of the present invention.

The preferred embodiment, a ground anchor generally identified by reference numeral 10, will now be described with reference to FIGS. 1 and 2.

Structure and Relationship of Parts:

Referring now to FIG. 1, there is shown ground anchor 10 including a body 12 having an upper surface 14, a lower surface 16 and a center of gravity 18. There are ground-piercing members 20 depending from lower surface 16 of body 12. Ground-piercing members 20, which may be provided in the form of teeth or tooth-like members generally as illustrated, are adapted to engage an underlying ground surface and have an orientation that provides more resistance in a first direction than in a second direction.

Figure 2:
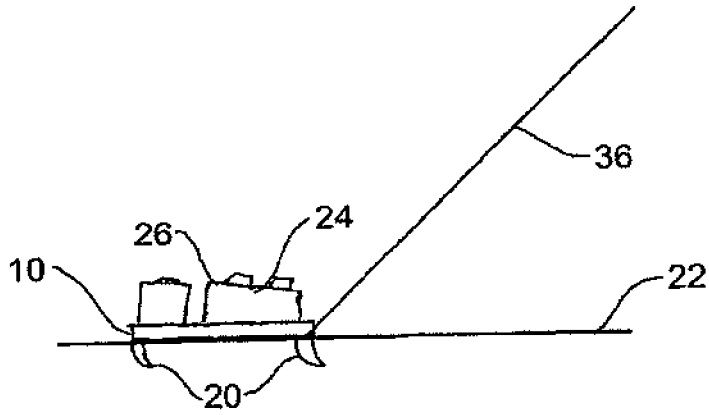
FIG. 2 is a side elevation view of the ground anchor illustrated in FIG. 1 in use anchoring a rig structure.

Referring to FIG. 2, ground-piercing members 20 prevent movement of body 12 along a ground surface 22. Ballast means 24 may be positioned on or in body 12 sufficient to maintain ground-piercing members 20 engaged with ground surface 22 when under load. As shown in FIG. 2, ballast 24 is a stack of weights 26 positioned on upper surface 14 of body 12.

Referring to FIG. 1, ground anchor 10 also includes an arm 28 having an attachment end 30 and a remote end 32, where attachment end 30 is pivotally attached to body 12 at approximately the center of gravity 18 and has an attachment ring 34 at remote end 32 of arm 28 that provides means for securing an anchor line 36 to body 12 as shown in FIG. 2.

Operation:

The use and operation of ground anchor 10 will now be discussed with reference to FIGS. 1 and 2. Referring to FIG. 2, ground anchor 10 is placed in the desired position, and ground-piercing members 20 engage underlying surface 22. Weights 26 are positioned on upper surface 14 of body 12 to maintain ground-piercing members 20 engaged with ground surface 22. Anchor line 36 is then attached to ground anchor 10. Referring to FIG. 1, anchor line 36 (not shown in FIG. 1) is attached to attachment ring 34 at remote end 32 of arm 28. Arm 28 is pivotally attached by attachment end 30 to body 12 such that different angles may be accommodated.

Figure 3:
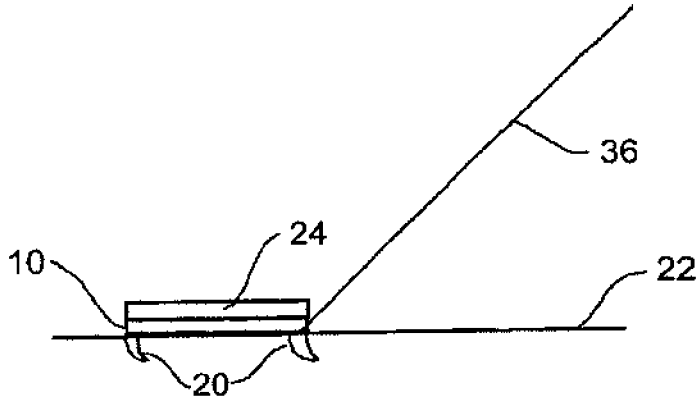
FIG. 3 is a side elevation view of a variation of the ground anchor illustrated in FIG. 1 in use anchoring a rig structure.

Variations:

A variation will now be discussed with reference to FIG. 3. In FIG. 2, ballast 24 is shown to be weights 26 that are positioned on upper surface 22. These weights are removable and separately transportable, which can make it easier to transport and position ground anchor 10. However, referring to FIG. 3, ballast 24 may also be integrally formed into body 12.

Figure 4:
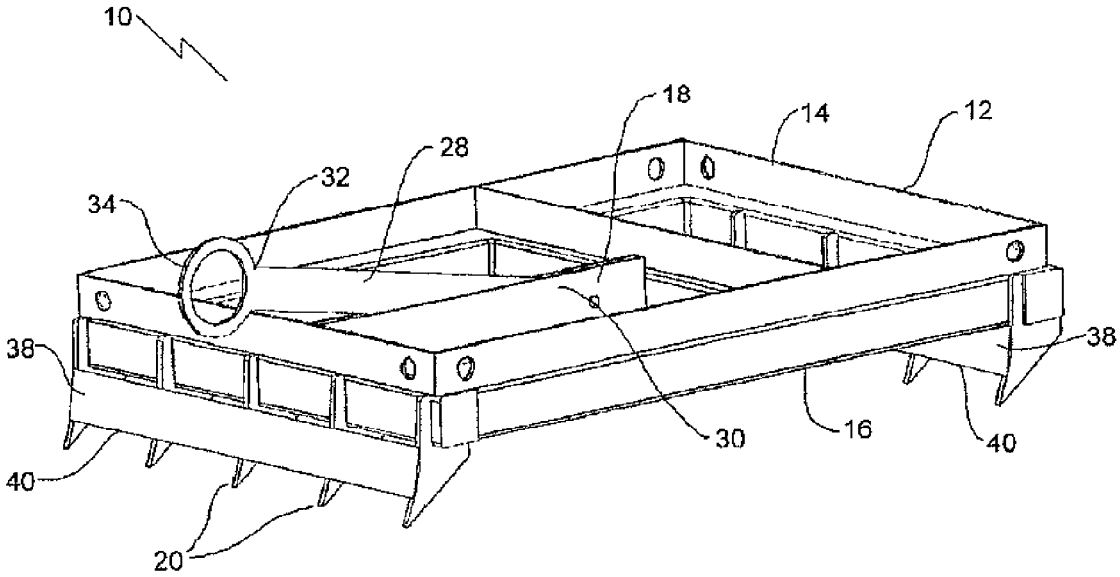
FIG. 4 is a perspective view of a variation of the ground anchor illustrated in FIG. 1.

Another variation is shown in FIG. 4, where a metal plate 38 or bar has been attached to ground-piercing members 20. Metal plate 38 has a cutting edge 40 to allow the apparatus to be inserted into the ground more easily. Metal plate 38 (which may be alternatively referred to as a ground-engaging blade member, or simply a blade member) acts as a member to increase the surface area perpendicular to the line of force to provide more resistance to movement. It will be understood that other means of increasing (i.e., supplementing) the perpendicular surface area are possible (for example, adding flanges to each side of each ground-piercing member 20).

Cautionary Warnings:

A force exerted upon the ground anchor by an anchor line will have a vertical force component or vector and a horizontal force component or vector. The ability of the ground anchor to hold when under load is dependent upon there being sufficient ballast to overcome the vertical force component that would otherwise pull the ground-piercing members out of the ground surface. The ability of the ground anchor to hold when under load is also dependent upon the ground-piercing members engaging the ground surface providing sufficient resistance to overcome the horizontal force component. One must review the soil conditions, as the resistance provided by the ground-piercing members will vary with the soil conditions. One must also ensure that there is sufficient ballast on the body for the ground anchor to overcome any anticipated intermittent additional loads, such as those that may be caused by wind gusts.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A ground anchor comprising:

(a) a body having an upper surface and a lower surface;

(b) a row of ground-piercing members rigidly fixed to and depending from the lower surface of the body;

(c) a ground-engaging blade member attached to and oriented transversely relative to the ground-piercing members; and (d) means for securing an anchor line to the body;

wherein the ground-piercing members have an orientation relative to the ground-engaging blade member such that the resistance provided by the ground-piercing members to a given horizontal force component acting on the body in a first direction perpendicular to the blade member is greater than the resistance provided by the ground-piercing members to the same horizontal force component acting on the body in a second direction opposite to said first direction.

2. A ground anchor as in claim 1, further comprising ballast integrally formed into the body.

3. A ground anchor as in claim 1, further comprising ballast in the form of weights forming a stack on the upper surface of the body.

4. A ground anchor as in claim 1, wherein the means for securing an anchor line to the body comprises an attachment ring.

5. A ground anchor as in claim 1, further comprising an arm having an attachment end and a remote end, wherein said attachment end of the arm is pivotally mounted to the body and wherein the means for securing an anchor line to the body is positioned at the remote end of the arm.

6. A ground anchor as in claim 5, wherein the means for securing an anchor line to the body comprises an attachment ring associated with the remote end of the arm.

7. A ground anchor comprising:

(a) a body having an upper surface and a lower surface;

(b) a plurality of ground-piercing members in the form of a row of teeth rigidly fixed to and depending from the lower surface of the body;

(c) a ground-engaging blade member attached to and oriented transversely relative to the teeth;

(d) ballast positioned on or in the body; and (e) means for securing an anchor line to the body;

wherein the teeth have an orientation relative to the ground-engaging blade member such that the resistance provided by the teeth to a given horizontal force component acting on the body in a first direction perpendicular to the blade member is greater than the resistance provided by the teeth to the same horizontal force component acting on the body in a second direction opposite to said first direction.

8. A ground anchor as in claim 7, wherein the means for securing an anchor line to the body comprises an arm having an attachment end and a remote end, said attachment end being pivotally attached to the body.

9. A ground anchor as in claim 8, wherein the first direction is perpendicular to one of the at least one blade members, and parallel to the arm.

10. A ground anchor as in claim 8, further comprising an attachment ring at the remote end of the arm.

11. A ground anchor as in claim 7, wherein the ballast comprises a stack of weights positioned on the upper surface of the body.

* * * * *